United States Patent [19]

Philip

[11] 4,019,348

[45] Apr. 26, 1977

[54] METHOD AND APPARATUS FOR SELECTIVELY RENDERING NEEDLES OPERATIVE AND INOPERATIVE ON A CIRCULAR KNITTING MACHINE

[76] Inventor: Morris Philip, c/o Philip Knitting Mill, 26 Bruckner Blvd., Bronx, N.Y. 10454

[22] Filed: May 14, 1975

[21] Appl. No.: 577,237

[52] U.S. Cl. ..... 66/24; 66/38

[51] Int. Cl.[2] ..... D04B 9/22

[58] Field of Search ..... 66/24, 51, 19, 46, 38, 66/172 R, 42, 46, 200, 21

[56] References Cited

UNITED STATES PATENTS

| | | | |
|---|---|---|---|
| 2,191,577 | 2/1940 | Mills | 66/51 X |
| 2,290,147 | 7/1942 | Booton | 66/51 |
| 2,685,185 | 8/1954 | Wagoner | 66/24 X |
| 3,487,660 | 1/1970 | Holder | 66/24 X |
| 3,509,735 | 5/1970 | Wiesinger | 66/24 |
| 3,537,278 | 11/1970 | Shields | 66/21 |
| 3,561,000 | 2/1971 | Wignall | 66/51 |
| 3,791,175 | 2/1974 | Imboden | 66/21 X |
| 3,835,668 | 9/1974 | Schiebel et al. | 66/24 X |
| 3,877,256 | 4/1975 | Roque | 66/24 |
| R25,101 | 12/1961 | Philip | 66/19 |

FOREIGN PATENTS OR APPLICATIONS

| | | | |
|---|---|---|---|
| 2,032,241 | 11/1970 | France | 66/46 |
| 573,992 | 12/1945 | United Kingdom | 66/51 |
| 226,078 | 5/1970 | U.S.S.R. | 66/24 |

*Primary Examiner*—Mervin Stein
*Assistant Examiner*—A. M. Falik

[57] ABSTRACT

A circular knitting machine and method of knitting in which the machine has a knitting cam track, an idle track and means for transferring selected needles from one track to the other, the machine having at least one set of needles movable through a knitting cycle by the cams in said knitting cam track and movable rearwardly to an inactive position in said idle track.

11 Claims, 7 Drawing Figures

METHOD AND APPARATUS FOR SELECTIVELY RENDERING NEEDLES OPERATIVE AND INOPERATIVE ON A CIRCULAR KNITTING MACHINE

The present invention is directed to methods of knitting and apparatus therefor and, more particularly, it is directed to method and apparatus for knitting wherein the needles of at least one set of needles of the machine are rendered inactive or prevented from knitting during a part of the operation of the machine.

Although the invention may be used with various types of knitting machines, it is particularly intended for use with circular knitting machines having at least two knitting banks, such as, for example, a dial and cylinder circular knitting machine. Furthermore, it is particularly directed to dial and cylinder circular transfer machines. Such transfer machines, as is well known in the art, are generally used to knit one portion of a fabric with a jersey pattern and to knit another portion of the fabric with a rib pattern. To make the change from rib knitting to jersey knitting requires the transfer of the loops carried by certain of the needles of one bank, usually the cylinder, onto needles of the other bank, the dial. When such machines are knitting rib, the fabric is knit with needles of the dial knitting with needles of the cylinder. All needles of the cylinder and dial knit or only part of such needles knit. When only part of the needles knit the rib, changeover is made to jersey knitting by transferring the loops from the cylinder needles to the dial needles. Jersey knitting is then continued by using all of the dial needles for knitting. The cylinder needles do not knit during the jersey knitting.

There are numerous short comings in the prior art transfer machines. Generally, such machines have a relatively small number of knitting feeds or knitting stations. They rarely exceed 12 or 16 feeds. The cams at each of the feeds are changeable so that, at each feed, position of the cams can be appropriately changed, depending on what that feed is to knit. As is known, the moving of the cams is automatically at appropriate times during the knitting operation. The automatic machines are usually equipped with a patterning control device, such as pattern chains, which, at appropriate times during the knitting of the fabric, actuate levers and other devices which, in turn, appropriately move the knitting cams. As has been stated, the cams position for each feed is changeable. This is often referred to as automatic cams. These automatic cams are relatively complicated and expensive. If it were desired to produce a transfer machine appreciably increasing the number of knitting feeds or knitting stations, let us say to 64 feeds which is at least four times as productive as a conventional machine, each of the feeds would require automatic cams. This would tremendously increase the cost of the machine. Furthermore, because of the nature of the levers and other devices which are used to effect the changes in the cams, and the space they occupy, it would be virtually impossible to make a 64 feed machine wherein the camming for each feed would be automatic.

The prior art machines, besides being limited in the number of knitting feeds, have other well-known shortcomings. For example, because of the nature of the cams used during the transfer operation, the machine must be appreciably slowed down while the transfer operation is taking place. When the prior art machines inactivate needles of a set from knitting, they accomplish this by leaving the needles of the set at about the welt position. This is done by moving the cam or cams which would automatically project those needles to a position whereby they do not project such needles. Thus, such needles remain in the welt position. Although a needle at the welt position normally does not knit, very frequently such needle, for various reasons well known in the art, will undesirably become projected sufficiently beyond the welt position to affect the fabric being knit. In other words, in the prior art machines, the non-knitting needles are not maintained in a position where they cannot interfere with the pattern being knit.

Another shortcoming of the prior art transfer machines is that the position of the cams which cause the transfer of the loops are fixed in their sequence relative to the other knitting stations of the machine. Thus, the operator of the machine cannot adjust the machine to knit the precise number of courses of a particular pattern which might be preferred.

The above shortcomings, as well as others of the prior art, are avoided by the present invention. Briefly, according to the invention, when it is desired that a set of needles be prevented from knitting, such needles are cammed rearwardly so as to move their butts out of the knitting or active cam track and into an idle or inactive track. The butts of the non-knitting needles remain in the idle or inactive track until it is desired that the needles again be used in the knitting operation. While the butts are in the idle track, such needles are inactivated. The machine continues to operate and knits with the other needles of the machine. The butts of the non-knitting needles remain in the idle track for at least a portion of the revolution of the machine, or may remain in the idle track for many revolutions of the machine, depending upon the pattern of the fabric being knit. In other words, the butts of the non-knitting needles are kept in the idle track at least until a plurality of courses are knit with the other needles of the machine.

Once the butts of the inactive needles have been moved to the idle track, such needles are effectively removed from the knitting process. The hooks of such needles are not only rearward of the welt position but also of the cast off position. As will be appreciated from the description of the illustrated embodiment of the invention, it is impossible for an inactive needle to inadvertently be projected forwardly to interfere with the knitting process.

When it is desired to change the knitting pattern from a pattern in which the needles whose butts are in the idle or inactive track are not used to a pattern in which such needles are to be used, cam means are provided for camming the butts of such needles from the idle track into the knitting or active track. As will be apparent from the following description of the invention because the butts of the inactive needles are in the idle track, the knitting cams at the stations where the active needles are to knit may be stationary knitting cams. Thus, the need for automatic or movable cams at each knitting station is eliminated. As a result, the present invention readily permits the manufacture of an automatic transfer machine having 64 knitting feeds, as well as special feeds for transferring, for moving needle butts into or out of the idle track, for welt start, for separating thread and for cast-off for separating.

It will also be apparent from the description that the invention permits the operator to vary the position of transfer relative to the sequence of other knitting stations. This enables the operator to more precisely adjust the number of courses to be knit for a particular pattern.

The cams which cause transfer of the loops are, according to the invention, so constructed that they permit the transfer operation to proceed without requiring that the machine be slowed down. This is accomplished by lengthening the transfer cams circumferentially so that the cams occupy about three times the circumferential space as do the prior art transfer cams. Thus, the transfer cams occupy the circumferential space for about three knitting stations. Such lengthening of the transfer cams permits the transfer operation to take place without slowing down the machine.

The foregoing aspects of the invention, together with other aspects, will be more readily apparent from the following description taken with the accompanying drawings, wherein.

Figure 1:
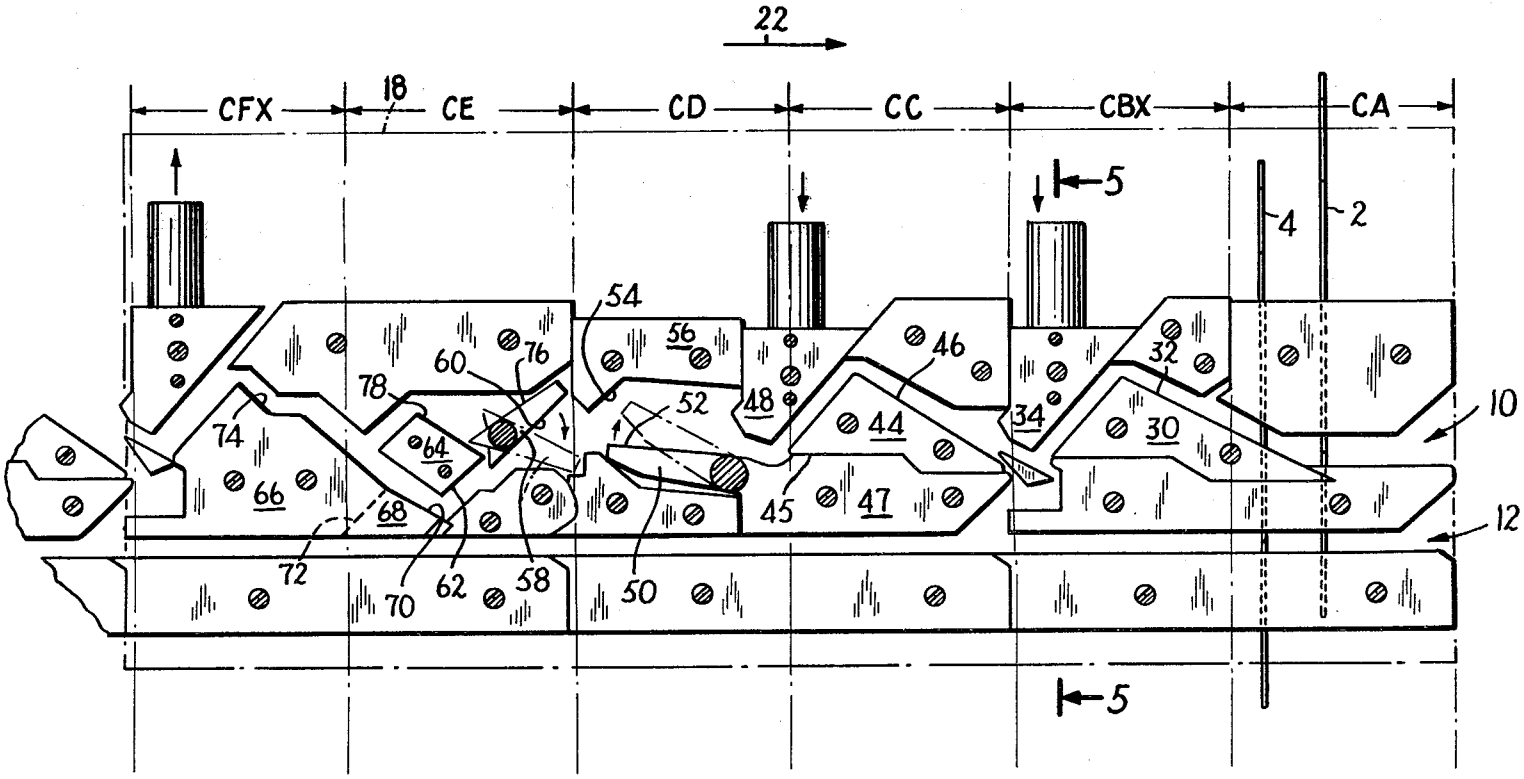
FIG. 1 is a diagrammatic developed elevation view of a portion of a cylinder camming assembly according to the invention showing the cams as viewed from outside and looking into the machine and showing the portion of the cylinder camming assembly which causes changeover of certain of the needles from the knitting track to the idle track.
Figure 2:
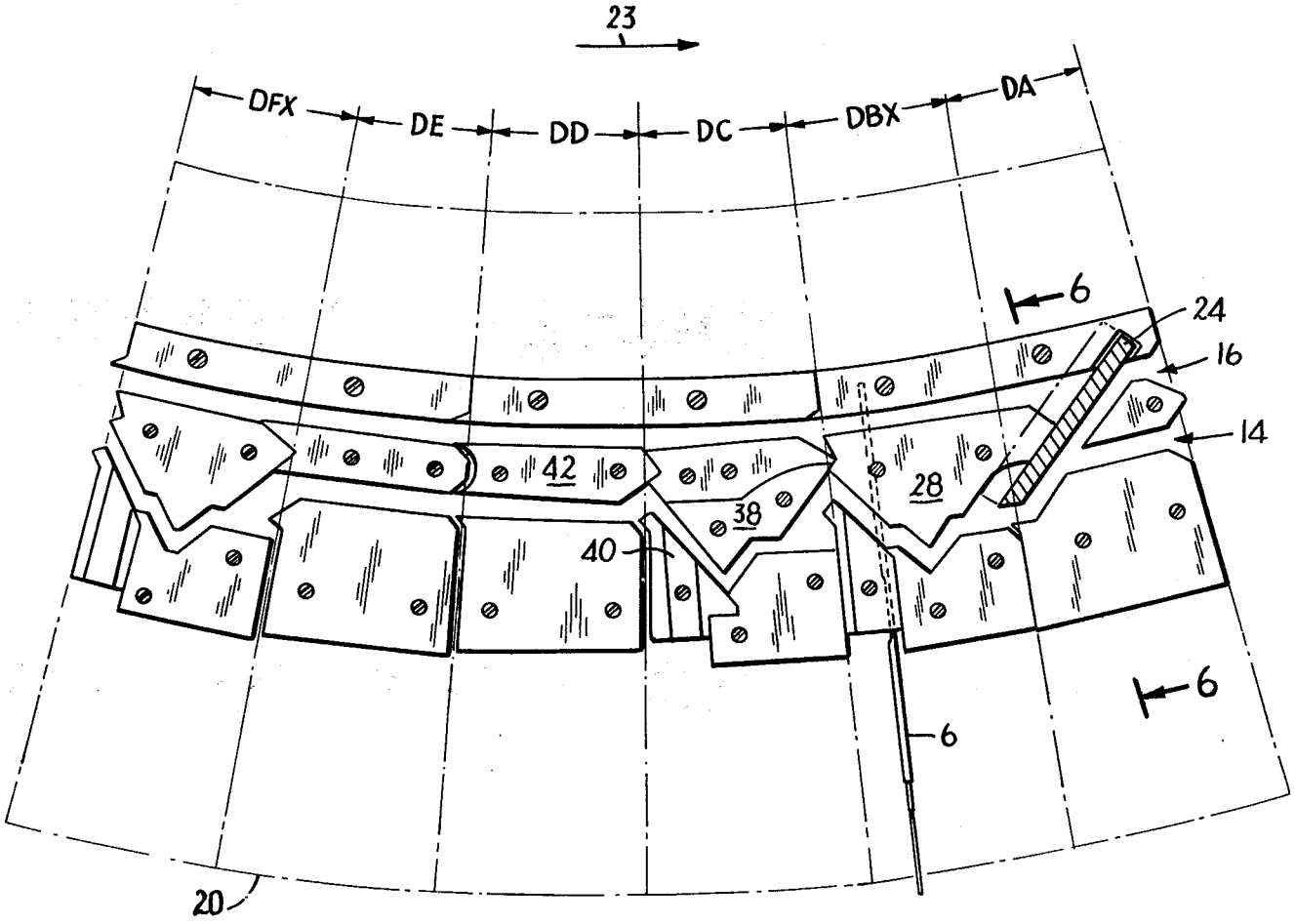
FIG. 2 is a diagrammatic top plan view of a portion of the dial cam assembly according to the invention which cooperates with the portion of the cylinder cam assembly shown in FIG. 1 and which shows the dial cam assembly as viewed from the outside and looking into the machine.
Figure 3:
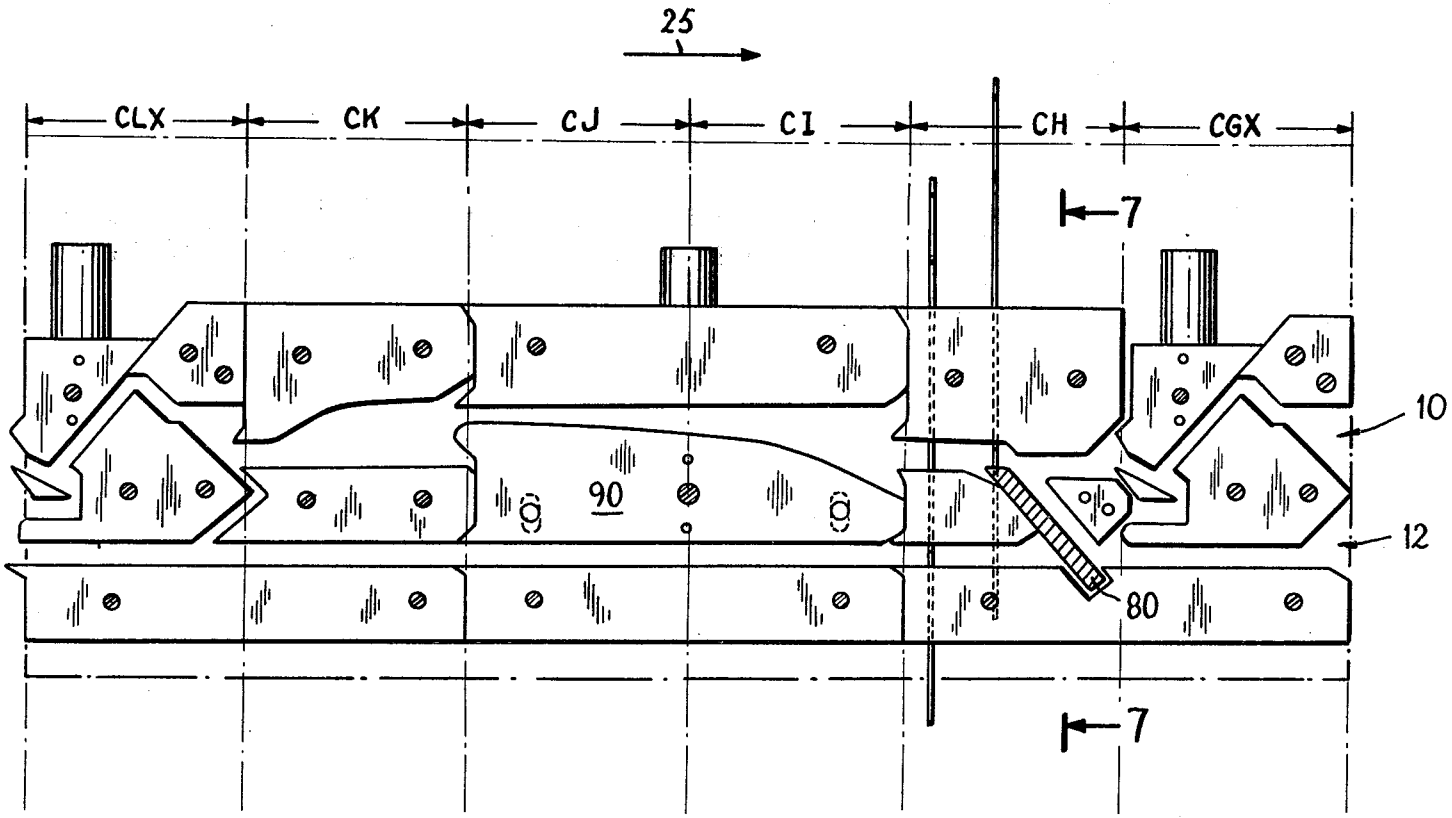
FIG. 3 is a diagrammatic developed elevation view similar to FIG. 1 but showing the portion of the cylinder camming assembly which reactivates the set of cylinder needles inactive during the rib knitting and which, when activated, cooperate with the dial needles to transfer the loops from the dial needles to such activated cylinder needles and commence jersey knitting.
Figure 5:
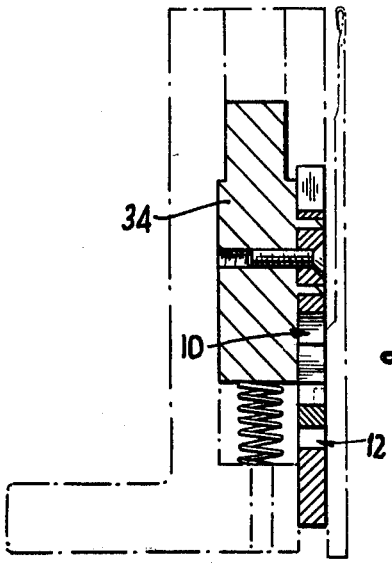
Figure 6:
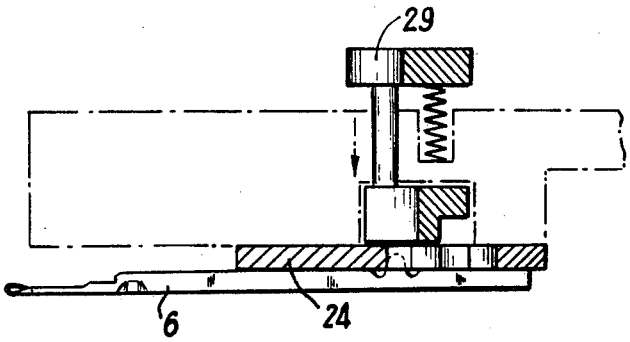
Figure 7:
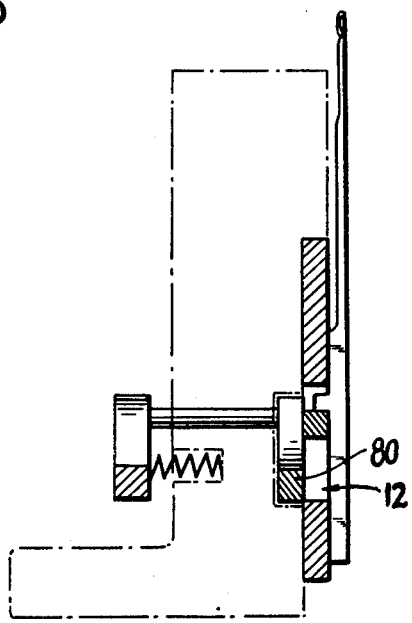

FIG. 5 is a sectional view, taken at 5—5 FIG. 1, showing the adjustable cam and actuator for controlling the length of the knitted stitch; FIG. 6 is a sectional view, taken at 6—6 FIG. 2, showing the movable cam and cam actuator for guiding the dial needles from the idle track into the knitting track; and FIG. 7 is a sectional view, taken at 7—7 FIG. 3, showing the movable cam and cam actuator for guiding the low butt cylinder needles from the idle track into the knitting track.

As will be appreciated from the description, the drawings show the camming diagrammatically and do not show the remainder of the machine, the structure of which is well known. Taken with the following description, the accompanying drawings are more than adequate to describe the invention to one skilled in the art.

The invention is directed to knitting with independent needles on a multifeed knitting machine and, particularly, circular knitting machines having at least two needle banks. The drawings show the pertinent portions of the camming assembly for such a machine where one needle bank is constituted by a cylinder and the other by a dial. The camming is shown substantially full size to scale as would be used in a cylinder and dial machine wherein the cylinder is about 30″ in diameter.

As is well known, cylinder and dial knitting machines are generally of two types. In one type, the revolving cam type, the cams revolve around the axis of the machine so as to move the needles, which are stationary relative to the machine axis, through their projection and retraction knitting cycle. In the other type, the revolving needle type, the cams are stationary relative to the machine axis and the needles revolves around such axis so that the cam moves the needles through their projection and retraction knitting cycles. In both machine types, the cams revolve relatively to the needles. The invention is applicable to both types of machines but, in the illustrated embodiment, the needles are stationary relative to the machine axis and the cams revolve.

In the illustrated embodiment, the cylinder is provided with two sets of needles, alternate needles making up one set having high butts and the needles therebetween making up the other set having low butts. The dial is provided with only one set of needles so that, functionally, each dial needle is disposed between two high butt cylinder needles. As is well known in the art, as such machine knits with all the dial needles knitting and only the high butt cylinder needles knitting, the fabric produced is a 1 × 1 rib. On the other hand, if such machine knits with all the cylinder needles, both high butt and low butt, knitting and without the dial needles knitting, the fabric produced is a jersey fabric.

If the machine is knitting 1 × 1 rib pattern, using the dial needles and only the high butt cylinder needles, as above described, and it is desired to change the knitting to the jersey pattern, the loops on the dial needles are transferred to the low butt cylinder needles and the dial needles are withdrawn from knitting. The high butt and low butt cylinder needles then knit the jersey pattern.

The camming illustrated in the accompanying drawings is for use in connection with a machine as just described. In the instant invention a set of needles of a needle bank is made up of a plurality of needles for use in one type of knitting, but not in another type of knitting. All of the members of the set have a characteristic which renders them different from other needles of that bank and which can be recognized by the camming. One such characteristic is identify members of a set is the height of the needle butt. In the illustrated embodiment, the members of one set of cylinder needles have a high butt and the needles of the other set have a low butt. High butt needles and low butt needles are commercially available and were well known in the art prior to the instant invention. The dial needles constitute only one set of needles and are all provided with the same butts. According to the present invention, the needles of each bank constitute at least one set. Each bank can have only one set of needles or may have two or more sets.

In the following description, reference will be made to changeable cam elements. In the illustrated embodiment, such changeable cam elements are of two types, plunger elements and swivel, or pivotable elements. Plunger elements are moved into or out of the needle bed and needle track to effect a change in the cam operation, while swivel elements are swung in a direction essentially parallel to the needle bed and are pivoted into and out of the needle track. Both types of changeable cams are well known in the art.

The invention is particularly intended to be used with an automatic machine. Generally, in such machines, the needles are disposed in grooves substantially completely around the needle bed and circumferentially around the machine, there being a blank space, without needles, in a small section of the circumference of the needle bed. Changes in the position of the knitting cams take place when the knitting cams are in the blank needle space. The position changes in the cams are effected by automatic patterning devices attached to the machine which, through levers, etc., either move the plunger cams toward or away from the needle bed, or pivot the swivel cams as desired. Such automatic devices are well known in the art and will not be further described.

Because the cams revolve relative to the machine axis and the needles are stationary relative to such axis, a revolution of the machine will cause all the needles to be passed once by all of the cams. All of the needles may not necessarily knit in every machine revolution. These details of the machine and cams are well known and therefore have not been illustrated.

Generally, the knitting cams, both on the cylinder and on the dial, are made up of a series of individual sections easily assembled onto the machine to form the cam assembly. Each cam section usually contains enough cam elements sufficient to constitue one knitting station, that is, to move the knitting needles through one cycle. In the illustrated embodiment, for convenience, each cam section shown in the drawing has sufficient camming elements for two knitting stations or cycles. In other words, each section has enough physical space for the camming for two cycles. However, as will be appreciated from the following specific description, in certain instances the space of a section equivalent to that of a cycle, or knitting station, may be effectively blank, or may contain camming elements which do not move the needle through a knitting cycle. Therefore, in the following description the word "feed" will essentially refer to the space which would be occupied by the camming sufficient for moving the needles through one knitting cycle and it will be clear from the context what function such "feeds" perform.

Referring to FIG. 1, there is shown a portion of the cylinder cam assembly, each section having therein appropriate camming elements to define a knitting cam track, generally designated 10, and an idle track, generally designated 12, rearward of track 10. In FIG. 2 there is shown a portion of the dial cam assembly, each section having therein appropriate camming elements to define a knitting cam track, generally designated 14, and an idle track, generally designated 16, rearward of track 14. In the drawings, FIG. 2 appears to be in the same plane as FIG. 1, but it will be appreciated that, in an actual machine, the dial cam assembly is essentially at right angles to the cylinder cam assembly. The forward edge 18 of the cylinder assembly is the edge thereof closet the forward edge 20 of the dial assembly and therefore, the idle track 12 is rearward of or below the knitting track 10 and idle track 16 is rearward of knitting track 14. In each case, the needles, 2, 4, FIG. 1, and 6, FIG. 2, which are moved by the corresponding cam assembly forwardly to take on the yarn, etc., and are retracted rearwardly or downwardly to draw the new stitch and cast off the old stitch.

Figure 4:
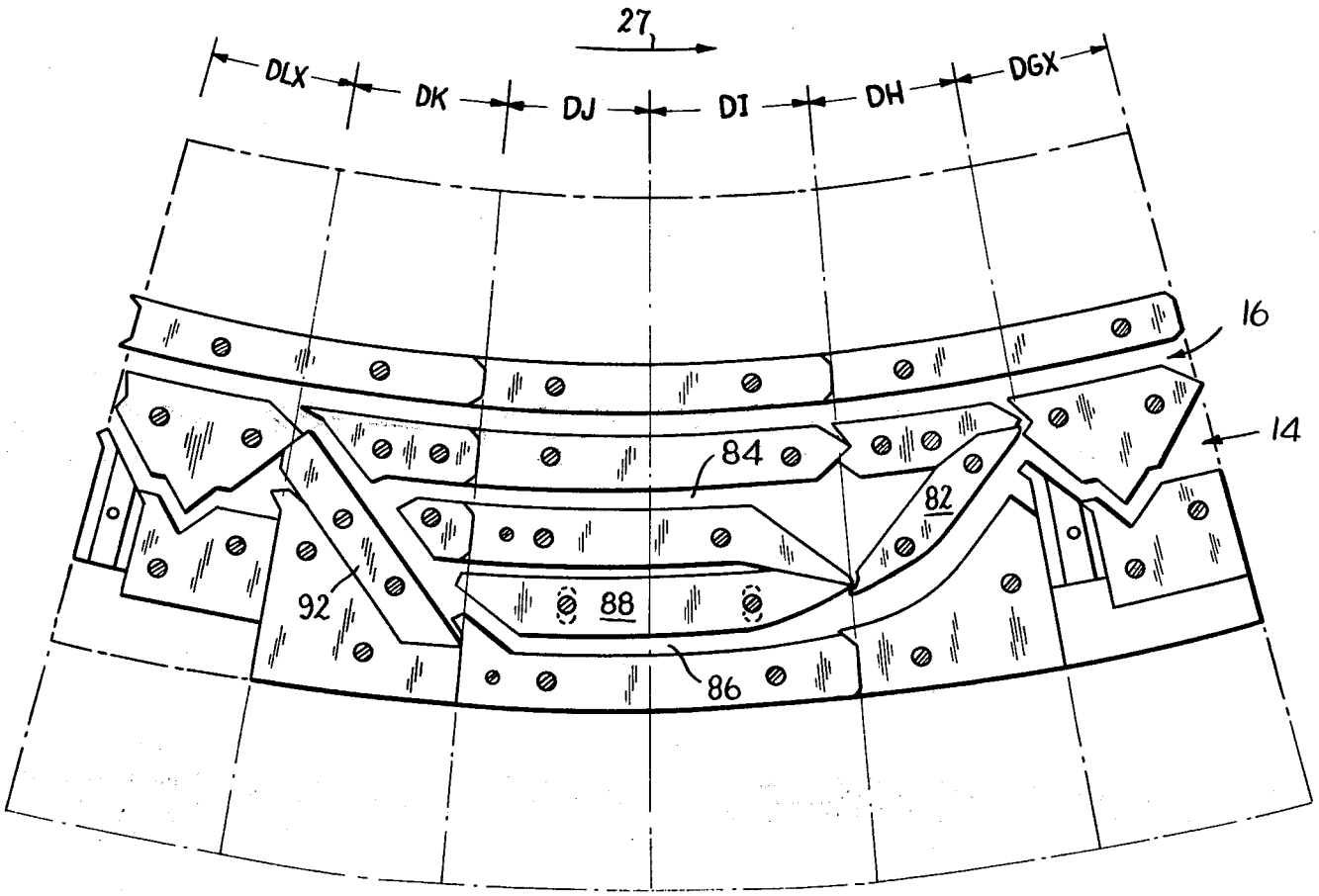
FIG. 4 is a diagrammatic top plan view similar to FIG. 2 but showing the portion of the dial camming assembly which cooperates with the portion of the cylinder cam assembly shown in FIG. 3.

In the illustrated embodiment, the cam assembly is moving relative to the needles in the direction of arrows 22, 23, FIGS. 1 and 2, arrows 25, 27, FIGS. 3 and 4. The butts of the needles in the cam track move from the right to the left, FIGS. 1–4, and, during such movement, are actuated by the camming surfaces of the cam elements. For reasons more apparent hereinafter, the cylinder cams, FIGS. 1 and 3, and the dial cams, FIGS. 2 and 4, have been divided into sections CA, CBX, CC, CD, CE, CFX, FIG. 1, CGX, CH, CI, CJ, CK, CLX, FIG. 3, DA, DBX, DC, DD, DE, DFX, FIG. 2, and, DGX, DH, DI, DJ, DK, DLX, FIG. 4. Correspondingly lettered cam sections on the cylinder are aligned with correspondingly lettered cam sections on the dial. Thus, cylinder cam section CA, FIG. 1, is aligned with dial cam section DA, FIG. 2; CBX with DBX, etc. cylinder cam section CGX, FIG. 3 is aligned with DGX, FIG. 4; CH with DH, etc.

It is convenient to begin the description with the machine in the position wherein it is knitting jersey so that all the needles in the cylinder, both the low butt and the high butt needles, are knitting and the dial needles are inactive or non-knitting. In order for the dial needles to be inactive, their butts must be in idle track 16. The butts of all of the cylinder needles, both low butt and high butt, are in knitting track 10.

The first cylinder cam section, FIG. 1, has a first feed CA and a second feed CBX, while the first dial section has a first feed DA and a second feed DBX. Feed DA has a plunger cam element 24 movable by plunger 29, FIG. 6, into and out of dial tracks 14, 16. When the machine is to change its knitting pattern from jersey to rib, the automatic equipment moves plunger 29 to move cam element 24 into dial tracks 14, 16 so that the butts of the dial needles will be cammed by camming element 24 and project the dial needles forwardly to about the tuck position. It is noted that camming element 24 intercepts idle track 16, as well as knitting track 14 and the effect is to bring the dial needles into knitting track 14. The second dial feed DBX is essentially a regular knitting feed and the cam element 28 therein moves the dial needles, after they have been released by cam element 24, to the clearing position and the remaining cam elements of feed DBX retract the dial needles to the cast-off position. In other words, the combined effects of feeds DA and DBX are to bring the dial needles out of idle track 16 and into knitting track 14 and then to knit one knitting cycle therewith. The first cylinder cam section CA is provided with a plunger cam element 30 which is partly in feed CA and partly in feed CBX. When the machine was knitting jersey plunger element 30 was projected all the way toward the cylinder needles so that camming suface 32 thereof would cooperate with the high butts and the low butts in knitting track 10. When the changeover to rib is to take place, plunger cam 30 is partially retracted (moved away from the cylinder needles) sufficiently so that the high butts will coact with camming surface 32 while the low butts will move across partially retracted plunger cam 30. Therefore, during the changeover feeds CA and CBX project the high butt cylinder needles to the clearing position by means of camming surface 32, while the low butt needles, unaffected by camming surface 32, remain at welt. The high butt needles are moved from the clear position to the cast off position by cam element 34 in feed CBX.

In the view of the foregoing description, during the changeover dial feeds DA and DBX and cylinder feeds CA and CBX cooperate with the needles to bring the dial needles from idle track 16 into knitting track 14 and knit one course of 1 × 1 with the high butt cylinder needles while the low butt cylinder needles remain as welt.

Since it is usual to finish off a jersey fabric with several courses of welt, it is desirable that cylinder feed CBX and dial feed DBX be followed by two sections each having two regular knitting feeds. Insofar as the camming is concerned, these feeds are regular knitting feeds, that is, they each have all the camming elements necessary to move the needles through a complete knitting cycle and are not shown in the drawings. The raising cam in the dial in each of these feeds is a plunger cam movable between a position where it will coact with the butts in the knitting track and a position where it will not coact with the butts in the knitting track. Since it is desired to knit four courses of welt at this time in the knitting operation, the plunger cam is retracted and the dial needles remain at welt. At the same time, the cylinder feeds knit all the cylinder needles, high butt and low butt, through four courses, thereby producing four courses of welt.

In this description the fabric being knitted is a series of sweater bodies wherein the body portion of the sweater is jersey and the bottom portion is rib. The machine repeatedly knits such sweater bodies with the bodies connected by a draw thread. When the draw thread is pulled out, the bodies become separated. In the knitting, the body is begun with the rib bottom. Therefore, the four courses of welt described in the previous paragraph describe the completion of one sweater body and it is now time to commence the next body, which will begin with a plurality of courses 1X1 rib. Following the regular knitting feed sections there are dial sections DC and DD and corresponding cylinder sections CC and CD. Dial feed DC has camming for a conventional knitting feed, except that raising cam 38 is a plunger cam movable between a position where it will cooperate with the needles in knitting track 14 and a position where it will not cooperate with the needles, so as to leave those needles at welt. During the changeover period, cam element 38 is in the active position and, therefore, will raise all the dial needles to the clearing position and cam element 40 of feed DC will retract the dial needles to draw the stitch. Dial feed DD has an element 42 therein which does not serve to project the needles and therefore feed DD may be considered to be a blank. The dial needles, after leaving feed DC, remain at welt at feed DD.

Cylinder feed CC has a plunger cam 44 movable between a retracted position wherein it does not cooperate with any butts in the knitting track 10 or a partly inward position wherein its camming surface 46 will coact with the high butts in track 10, but will not coact with the low butts in track 10. In the changeover position, cam element 44 is in the inward position where its camming surface 46 will coact with the high butts and therefore the high butt needles will be raised by the camming surface 46 to the clearing position while the low butt cylinder needles will remain at welt. The yarn or thread which is knit with feeds CC and DC is the separator thread. It is therefore apparent that feeds CC and DC knit in the separator thread as 1X1 rib, cylinder cam element 48 serving to cast off that thread from the cylinder needles. The low butt cylinder needles at this point still have loops thereon from the preceding regular knit feed.

Cylinder feed CD has a swivel cam element 50 pivotable, essentially in the plane of the cylinder needles, between an upper position, as shown in phantom lines in FIG. 1, and a lower position, shown in full lines in FIG. 1. During the changeover element 50 is in the upper position and all the cylinder needles, both high butt and low butt, will be raised to the clearing position by camming surface 52 of element 50 and camming surface 54 of cam element 56 starts moving all of the cylinder needles rearward toward the cast off position. No yarn is supplied to the needles when they are being acted on by feeds CD and DD. Therefore, the net result of feed CD is to begin the movement of all the cylinder needles, both high butt and low butt, toward the cast off position. This action is completed by the next cylinder feed, but it is now pointed out that when the cylinder needles complete the cast off, the fabric will be maintained in the machine only by the loops on the dial needles, since feed DD was a blank and kept the dial needles as welt with loops of the separator thread thereon.

The next dial section is constituted by feeds DE and DFX, Feed DE, as feed DD, is a blank, so that the dial needles still remain at welt, while feed DFX is a regular feed moving the dial needles through a regular knitting cycle. Cylinder feed CE, which follows cylinder feed CD, serves a dual function during the changeover. It completes the casting off of all the cylinder needles and separates the high butt needles from the low butt needles by directing the low butt needles into the idle track 12, while bringing the high butt needles back into the knitting track 10. Feed CE has a swivel, or pivoting cam element 58 movable between an upper position, shown in solid lines in FIG. 1, and a lower position, shown in phantom lines. During the changeover, swivel cam element 58 is in the upper position and it will be appreciated that after the butts of the cylinder needles leave cam surface 50 of the preceding feed, they will engage the lower camming surface 60 of swivel element 58. Camming surface 60 therefore directs all the cylinder needles rearwardly until they are engaged by camming surface 62 of camming element 64 which coacts with the high butts and low butts and continues urging all the cylinder needles rearwardly. After leaving the rearward edge of camming surface 62, the cylinder needles coact with separating cam 66.

Separating cam 66 is provided with a cutout or recess 68 which begins at the rearward edge of camming surface 62. The cutout begins at the inward surface of element 66, namely, the surface closest the cylinder needles. The cutout is of such a depth that the edge 70 defining the forward side of the cutout is spaced apart from the surface of the cylinder needles sufficiently to permit the low butts leaving camming surface 62 to pass surface 70. On the other hand, the recess is not sufficiently deep to prevent the high butts from coacting with surface 70. It will therefore be apparent that when the needles leave surface 62 the low butt needles will enter recess 68 and will remain therein until they are reached by camming surface 72. Camming surface 72 will cam the low butts rearwardly. Since recess 68 is in communication with idle track 12, camming surface 72 will direct the low butt needles into the idle track. The high butt needles, on the other hand, will coact with camming surface 70 and be moved upwardly to be further forwardly cammed by surface 74 of cam 66. It will be readily apparent that feed CE produces a separation between the high butt cylinder needles and the low butt cylinder needles, urging the low butt needles into the idle track, while maintaining the high butt needles in the knitting track.

Feed CFX has the camming for the regular knitting cycle and will act on all the needles in the knitting track. Therefore, feed CFX will move the high butt needles through a knitting cycle. It is apparent that feeds CFX and DFX cooperate to produce a 1 × 1 rib course knit by all the dial needles and the high butt cylinder needles. Following feeds DFX and CEX are a plurality of cam sections, each providing two regular knitting feeds, the number of sections depending upon how many course of 1 × 1 rib it is desired to knit. It will be apparent that after feeds CFX and DFX the low butt cylinder needles are in the idle track and therefore all knitting thereafter will be 1 × 1.

As stated, immediately following feeds DFX and CFX the dial and cylinder cam assembly are each provided with a plurality of regular knitting feeds so that they will knit a 1 × 1 rib pattern. Nevertheless, it is usually desirable that the feed course of rib knitting, namely, the course produced by feeds DFX and CFX, be followed by two courses of welft. Therefore, the two dial feeds immediately following feed DFX are provided with plunger raising cams movable between a position where they will raise the dial needles to the clearing position and a position where they will not affect the dial needles so that the dial needles will remain at welt. During the changeover these cams in the first two dial feeds following feed DFX are placed in the inactive position and therefore the two courses following the course knit with feeds DFX and CFX will be two courses of welt knitting only on the cylinder needles.

At this point it is desirable to emphasize that whenever a feed is identified as an ordinary or regular knitting feed, it has all the necessary camming elements in any conventional knitting feed to move the needle through a complete cycle. Furthermore, according to this invention, such knitting feeds have their cam elements so constructed that they will act on all the needles, both high butt and low butt, in the knitting track. However, according to the invention, such ordinary feeds each have, in addition to the ordinary camming defining the knitting cam track, an idle track positioned rearwardly of the knitting track and which, in each feed, is aligned with the idle track of the other feeds.

The cylinder cam assembly and dial cam assembly, after the desired number of ordinary feeds which are conventional and are not shown in the drawings, have additional special feeds as shown in FIGS. 3 and 4. In other words, the ordinary cylinder feeds are followed by a cylinder cam section whose first feed is CGX, an ordinary knit feed, and whose second feeds is CH. After the cylinder needles have been acted on by the last of the ordinary feeds CGX, they will be acted on by feed CH. In a similar manner, the ordinary dial feeds are followed by a dial cam section whose first feed is DGX, an ordinary dial feed, and whose second feed is DH. The portions of the cam assembly shown in FIGS. 3 and 4 also move relative to the needles in the direction of arrows 25, 27. The cylinder portion in FIG. 3 continues knitting cam track 10 and idle track 12 while the dial portion of FIG. 4 continues knitting track 14 and idle track 16.

It will be recalled that the ordinary feeds were last knitting 1 × 1 rib with the dial needles and the high butt cylinder needles, the low butt cylinder needles remaining in the idle track. In the event there are not sufficient ordinary feeds between feeds CFX-DFX and CGX-DGX in one revolution of the machine to provide sufficient courses of 1 × 1 rib, the special transfer feeds of FIGS. 3 and 4 can be rendered inactive, as will subsequently be described. When the special feeds of FIGS. 3 and 4 are rendered inactive, feeds CBX and DBX, and the conventional knitting feeds thereafter, combine to knit a further course of 1 × 1 rib.

During the knitting of the 1 × 1 rib portion of the fabric, feeds DC, DD and DE are not supposed to act on the needles to knit and the corresponding cylinder feeds CC, CD and CE are not supposed to act on the needles to knit. Dial feed DC is prevented from knitting the dial needles by retracting cam element 38 to a position where it will not act on the dial needles. Because dial feeds DD and DE are permanently blanks, that is, they do not project the needles, none of the dial feeds DC, DD or DE will act on the dial needles and therefore the dial needles will remain at welt. In cylinder feed CC, plunger cam 44 is retracted so that it will not cooperate with the butts in the knitting track and therefore the butts of the cylinder needles move along the upper surface 45 of cam element 47. Swivel cam 50 in feed CD is moved to the lower position shown in solid lines, FIG. 1. The butts of the cylinder needles leaving surface 45 move onto surface 52. In feed CE swivel cam element 58 is moved to the lower position shown in phantom lines, FIG. 1. The butts leaving cam surface 52 of cam element 50 then ride along the upper surface 76 of swivel cam element 58 until the needles arrive at the surface 78 of cam element 64. It will be appreciated from the drawings that the movement of the butts of the cylinder needles along the various elements of feeds CC, CD and CE do not raise the cylinder needles to a position where they will act or knit.

In view of the above, as the cylinder and dial needles pass through feeds DC, DD, DE and CC, CD and DE, no knitting takes place. When the needles arrive at feeds CFX and DFX, 1 × 1 rib is again knit, because these two feeds act on the needles as originally described. The machine can now continue revolving for as many revolutions as necessary and continue knitting 1 × 1 rib. It should be borne in mind that during this process the butt of the low butt cylinder needles remain in idle track 12 and therefore, are out of the knitting action.

At this time it will be convenient to describe how the feeds shown in FIGS. 1 and 2 can return to knitting jersey if it is desired and continue knitting jersey. It will be recalled that, during the knitting of jersey, the butts of the dial needles are in the idle track while the low butts and high butts of the cylinder needles are all in cylinder knitting track 10. Thus, to discontinue knitting of 1 × 1 rib and commence jersey knitting, the butts of the low butt cylinder needles must be removed from idle track 12 and cammed into knitting track 10, the stitches on the dial needles must be transferred to the low butt cylinder needles and the butts of the dial needles must be cammed from knitting track 14 of the dial into dial idle track 16. As jersey knitting continues, the butts of both the high butt and low butt cylinder needles are in cylinder knitting track 10 and the butts of the dial needles are in dial idle track 16.

The camming of the low butt cylinder needles from cylinder idle track 12 into cylinder knitting track 10, the knit stitch transfer from the dial needles to the low butt cylinder needles and the camming of the butts of the dial needles from dial knitting track 14 into dial idle track 16 is accomplished in cylinder feeds CGX, CH, CI, CJ, CK, CIX, FIG. 3 and dial feeds DGX, DH, DI, DJ, DK, DLX, FIG. 4.

The butts of the low butt cylinder needles are cammed from cylinder idle track 12 into cylinder knitting track 10 by cam 80, FIG. 3. During the preceding 1 × 1 rib knitting, cam 80 was retracted and, as the rib knitting was completed, the plunger, not shown, of cam 80 is actuated, projecting cam 80 into idle track 12 so as to cam the butts of the low butt cylinder needles from the idle track into knitting track 10.

At the same time that cylinder cam 80, feed CH, FIG. 3, is projected, dial cam 82, which during 1 × 1 rib knitting is withdrawn, is projected into dial knitting track 14. Thus the butts of the dial needles, feed through track 84 during rib knitting with dial cam 82 withdrawn, are cammed by cam 82 into track 86. The stitches on the dial needles from the rib knitting are transferred from the dial needles to the low butt cylinder needles as the needle butts cam over dial cam 88 and needle cam 90, respectively. As shown in FIGS. 3 and 4, cams 88, 90 are adjustable and are adjusted so that the hook ends of the low butt cylinder needles and the dial needles will inter-act to effect the stitch transfer. The dial needles are projected by dial cam 88 through the tucking position, clearing position and finally to a position slightly forward of the clearing position. The dial needles are transfer needles. These transfer needles are provided with recesses or hollows so that, during transfer, such needles will not collide and stitch transfer can be effected.

The knit stitch transfer from the dial needles to the cylinder needles is effected in cylinder feeds CI, CJ, FIG. 3 and dial feeds DI, DJ, FIG. 4. After such stitch transfer, the butts of all of the cylinder needles, both low butt and high butt, are in cylinder knitting track 10. Thus, all of the Cylinder needles will knit. The butts of the dial needles, as they pass from track 86, dial feed DJ, into dial feed DK, are cammed by cam 92, projected by a cam plunger, not shown, into dial knitting track 14, from knitting track 14 into dial idle track 16. With the butts of the high butt and low butt cylinder needles cylinder knitting track 10 and the butts of the dial needles in idle track 16, jersey knitting commences and continues until the next camming transfer of the needle butts.

In the instant invention, the cam arrangements in cylinder feeds CBX, CFX, FIG. 1, and CGX, CLX, FIG. 3, and dial feeds DBX, DFX, FIG. 2 and DGX, DLX, FIG. 4, are knitting feeds and have all of the elements for moving needles through a knitting cycle. At times, such as when welting, certain of the cam elements in such knitting feed may be rendered inactive, such as by withdrawal from the knitting track, as is conventional in knitting. The arrangements in cylinder feeds CA, CC, CD, CE, FIG. 1, and CH, CI, CJ, CK, FIG. 3 and dial feeds DA, DC, DD, DE, FIG. 2 and DH, DI, DJ, DK, FIG. 4 are special feed which do not knit, except CC, FIG. 1 and DC, FIG. 2, which knit in the separator thread.

The special feeds of the cylinder and dial of FIGS. 1 and 2 are separated from the special feed of the cylinder and dial of FIGS. 3 and 4 by regular knitting feeds. There is no criticality in the number of such regular knitting feeds which must intervene between the sets of special feeds. This gives the operator the freedom to separate the group of special feeds by any appropriate number of regular feeds to produce the pattern it is desired to knit.

The cam of the special feeds of the instant invention which effect the transfer of the stitches between the low butt cylinder needles and the dial needles are spread over a distance of about three feeds. This spread reduces the relative movement between the needles and the cams and eliminates the need for reducing machine speed as heretofore practice in effecting stitch transfer. Thus, slowing down of the knitting operation at the feeds which are knitted at the same time the special feeds are effecting transfer is also eliminated.

The cam structure, as diagrammatically illustrated herein, can easily be utilized on a dial and cylinder circular multifeed knitting machine having a dial 30 inches in diameter to provide 64 knitting feeds in addition to the special feeds described herein. It will be appreciated that since most of the knitting feeds need not be changeable or involved in the automatic patterning aspect of the machine, such a machine is more satisfactory, more economic to construct, and easier to operate than any machine using prior art techniques could possibly produce.

An important aspect of the invention is the provision of means to move the butts of a set of needles out of the active track into an idle track and subsequently to return those butts to the active or knitting track. This concept can be used independently of other aspects of the illustrated embodiment. For example, it could be used with cam assemblies having different transfer means or with cam assemblies which do not utilize transfer. In a similar manner, where in the foregoing description certain courses were knit welt, this again is a matter of choice for a worker skilled in the art. In many patterns a separatory thread need not be utilized and of course, the invention is just as applicable to that type of knitting.

It will be appreciated that in the illustrated embodiment, the dial needles constitute only one set and, at an appropriate time in the knitting process, that entire set was rendered inactive and was subsequently rendered active. On the other hand, the cylinder needles were divided into two sets with only one set being rendered inactive and then active. The other cylinder set always remained in the knitting track. It will be recognized that the invention therefore, in its broader sense, merely contemplates rendering one set of needles of a knitting bank inactive by moving the butts thereof into an idle track. Subsequently, after at least several courses have been knit, or stated differently, after at least a partial revolution of the machine, the butts of that set may be moved into the knitting track. Of course, the butts may remain in the idle track for one revolution of the machine, or for as many revolutions as desired. The set of needles whose butts are moved to the idle track may constitute all of the needles of a particular bank or may constitute only one set of the plurality of sets in a needle bank.

When the butts of the needles to be rendered inactive are moved rearwardly from the knitting track to the idle track, the needles themselves, and particularly the hooks thereof, are moved rearwardly beyond the cast off position. In this manner, the hooks of the needles are clearly kept out of the way of the other needles which continue knitting. Furthermore, when the needles are so moved rearwardly to be inactivated they are kept in the rearward position until it is desired to activate them and move their butts into the active or knitting track.

It will be appreciated from the foregoing that a cam assembly according to the invention defines at least one active or knitting track and at least one idle or inactive track rearwardly of the knitting track. Although the butts of the inactive needles are confined within the idle track, the butts are neither projected nor retracted while in such track and therefore the idle track should not technically be called a cam track, although in the looser sense, since it does guide the needles, it may be called an idle cam track.

In the method and apparatus of the instant invention, movement of the dial and selected set of cylinder needles into and out of the active knitting track and the idle or inactive track is controlled and, when in the idle track, the needles are held and positively restrained from interference with the needles which are knitting. While being advanced from the idle or inactive track into the active or knitting track, the advance of such needles is also controlled. Thus, possible interference and resulting damages which would be caused thereby are avoided. Furthermore, the need to rotate one set of the needles relative to the other while the sets are being advanced from the idle track or being withdrawn into such track and to rotate such set back into knitting position, is also avoided. Unlike the relative off-setting of the needle sets relative to each other, as is conventional for stitch transfer on flat knit machines, in the instant invention the relative positioning of the cylinder needles relative to the dial needles remains fixed. The need for apparatus and mechanisms, which in the instant case of a rotary knitting machine would be complicated, to rotate one set of needles relative to the other for transfer and back to their original position for knitting, is eliminated.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. In a method of knitting a tubular fabric with both rib and plain portions on a dial and cylinder circular knitting machine having a plurality of needle sets thereon, the needles in each of said sets being movable, forwardly from a cast off position through a knitting cycle the steps of moving at least one of the sets of needles rearwardly of said cast off position to an inactive position and maintaining said rearwardly moved needles in said inactive position until at least one course is knitted by the remaining needle set or sets whereby said needles in said inactive position do not knit and do not have any fabric thereon.

2. In a method of knitting, as recited in claim 1, wherein said rearwardly moved needles are moved forwardly to a knit position to knit after at least one course is knitted by said machine.

3. In a method of knitting, as recited in claim 2, in which the needles on the cylinder are divided into a first set and a second set, the needles of one of said sets being moved rearwardly of said cast off position to an inactive position and maintained in said inactive position until at least one course is knitted by said other set of needles.

4. In a method of knitting with a circular knitting machine having a cylinder and dial and one set of dial needles and at least two sets of cylinder needles, said needles being movable forwardly from a cast off position through a knitting cycle, the steps of moving at least one set of said cylinder needles rearwardly of said cast off position to an inactive position and holding said rearwardly moved cylinder needles in said inactive position until at least one course is knitted by the remaining sets of cylinder and dial needles whereby said needles in said inactive position do not knit.

5. In a method of knitting, as recited in claim 4 including the steps of moving forwardly to an active knitting position said set of cylinder needles moved and held in said inactive position while at least one course was knitted and, while moving said set of cylinder needles forwardly, transferring the stitches on said dial needles from said dial needles to said forwardly moving inactive cylinder needles and, after said stitches are transferred moving the dial needles aligned with said forwardly moving cylinder needles rearwardly of said cast off position to an inactive position and holding said rearwardly moved dial needles in said inactive position until at least one course is knitted by said cylinder needles whereby said dial needles in said rearward inactive position do not knit.

6. In a knitting method, as recited in claim 5 wherein said one set of cylinder needles and said dial needles knit a $1 \times 1$ rib pattern.

7. A method as recited in claim 6 in which said cylinder needles, after said dial needles are moved rearwardly and are maintained in said rearward inactive position, knit a jersey pattern.

8. In a dial and cylinder circular knitting machine having a plurality of needle sets thereon for the manufacture of a tubular fabric with both rib and plain portions the needles in each of said sets being movable forwardly from a cast off position through a knitting cycle the improvement comprising a first means for moving said needles forwardly from a cast off position through a knitting cycle and for returning said needles to said cast off position, second means fixedly mounted rearwardly of said first means for engaging and holding said needles rearwardly of said cast off position thereby preventing them from being moved through a knitting cycle for at least one course while the remaining needle set or sets knit, and third means for engagement in said first and second means for selectively engaging certain of said needles in said first means and for transferring said selected needles to said second means.

9. In a circular knitting machine as recited in claim 8 including fourth means engageable in said second means for transferring said selected needles in said second means to said first means.

10. In a circular knitting machine having a cylinder and dial, at least one set of needles on said cylinder and one set of needles on said dial, the improvement comprising a first means on said dial for moving said needles forwardly from a cast off position through a knitting cycle and for returning said needles to said cast off position, second means on said dial rearwardly of said first means for holding said needles rearwardly of said cast off position and for preventing said needles from being moved through a knitting cycle, third means on said dial for engagement in said first and second means with certain of said needles for selecting said certain of said needles in said first means and for transferring said selected needles to said second means and fourth means engageable in said second means for transferring said selected needles in said second means to said first means.

11. In a circular knitting machine, as recited in claim 10, in which said first means and said second means are cam tracks.

* * * * *